US006170613B1

(12) United States Patent
Privé

(10) Patent No.: US 6,170,613 B1
(45) Date of Patent: Jan. 9, 2001

(54) AUTONOMOUS TILTING PLATFORM UNIT

(75) Inventor: Robin Privé, St-Léon (CA)

(73) Assignee: Gercom Construction Inc., St-Nazaire (CA)

( * ) Notice: Under 35 U.S.C. 154(b), the term of this patent shall be extended for 0 days.

(21) Appl. No.: 09/332,743

(22) Filed: Jun. 14, 1999

(30) Foreign Application Priority Data

Jun. 15, 1998 (CA) ..... 2239273

(51) Int. Cl.[7] ..... B66B 9/16
(52) U.S. Cl. ..... 187/245; 187/239; 187/261
(58) Field of Search ..... 187/245, 239, 187/247, 261, 410

(56) References Cited

U.S. PATENT DOCUMENTS

| | | | | |
|---|---|---|---|---|
| 3,312,307 | * | 4/1967 | Camp | 187/245 |
| 3,344,885 | * | 10/1967 | Rasmussen | 182/16 |
| 3,891,062 | * | 6/1975 | Geneste | 187/245 |
| 4,550,806 | * | 11/1985 | Bocker | 187/246 |
| 4,693,186 | * | 9/1987 | Lisa | 105/329.1 |
| 4,793,437 | * | 12/1988 | Hanthorn | 182/102 |
| 5,143,181 | * | 9/1992 | Bixby | 187/245 |
| 5,595,265 | * | 1/1997 | Lebrocquy | 187/261 |
| 5,954,143 | * | 9/1999 | McCabe et al. | 173/184 |

FOREIGN PATENT DOCUMENTS

| | | | | |
|---|---|---|---|---|
| 3634702 | * | 4/1988 | (DE) | 187/245 |
| 3816156 | * | 11/1989 | (DE) | 187/239 |
| 317782 | * | 5/1989 | (EP) | 187/245 |
| 341563 | * | 11/1989 | (EP) | 187/245 |
| 256973 | * | 11/1969 | (SU) | 187/245 |

* cited by examiner

*Primary Examiner*—Robert P. Olszewski
*Assistant Examiner*—Paul T. Chin
(74) *Attorney, Agent, or Firm*—Merchant & Gould P.C.

(57) ABSTRACT

The autonomous tilting platform unit is for infrastructure work over a 0–90° slanted surface. It has a platform assembly pivotally connected to a carriage assembly provided with wheels for displacement over the surface. An autonomous motor unit is mounted on the carriage assembly through a pendulum assembly. The tilting angle of the platform assenbly with respect to the carriage assenbly is adjusted with a jack device powered by the motor unit. A pair of winches powered by the motor hoist the platform unit along the slanted surface. A control unit is mounted on the platform assembly, and operates the motor unit and controls the jack device and the winches.

13 Claims, 5 Drawing Sheets

AUTONOMOUS TILTING PLATFORM UNIT

The present invention relates to scaffolding, and more particularly to an autonomous multi-position working platform unit intended especially for repair and renovation work of large scale construction structures such as hydroelectric dams or other civil engineering works.

BACKGROUND

The repairing of dams is carried out in environments that involve many constraints: infrastructure having an important slope; work surfaces varying between 0–90°; security of the workers; important weight of the equipment, and vibrations produced by certain types of equipment (e.g. drill); delays for the work; complex installations; required precision in the work achievement; non conventional scaffolding; limited workspace; difficult and limited access; cluttering of the work areas.

The execution of the work requires complex logistics which must adapt to the environmental conditions and ensure the security of the workers. At this time, the work is carried out on precarious installations that do not respect certain or all of the aforesaid constraints.

The conventional method for the execution of the work on dam runners requires the full-time mobilization of a crane, the continuous moving of scaffolding, the operation of tools on various work surfaces, a constricting security program, many persons to meet the needs of the workers, exhausting work for the drillers, long delays in the fulfilment of the work, etc. For example, the project manager establishes the work methods and the appropriate directives, and plane the intervention of subcontractors, the site operations, the various work stages, the work schedule and the budgets. He proceeds with the purchase and rental of the material, equipment and other required elements, and then to the design of the scaffolding with the assistance of a structure engineer to meet the requirements of the contractor, the committee for social security and health, and the owner. The contractor then proceeds with the production of the scaffolding according to the plants Procedures are developed for the set-up of the equipment and the tools, and their removal when the work is finished. To install the scaffolding and continuously move it, for example, to drill holes at various locations, a crane must be installed permanently during the entire time of the work execution. At each move, the scaffolding must be anchored on its base, which takes time and requires considerable labour force. The staircase of the scaffolding must be lengthened on the entire length of the runner during displacement of the scaffolding, which represents highly important equipment costs. The drilling of holes is executed by hand, which constitutes a very exhausting and dangerous work for the workers.

SUMMARY

An object of the invention is to provide a platform unit that overcomes the drawbacks associated with the methods and equipment of the prior art.

Another object of the invention is to provide such a platform unit, which facilitates the job of the workers and improves the security level on sites.

A subsidiary object of the invention is to provide such a platform unit, which can go up or down on the slope of a dam runner or another structure according to the requirements of an operator located on the platform.

A subsidiary object of the invention is to provide such a platform unit, which can be level adjusted over a large range of tilt angles.

A subsidiary object of the invention is to provide such a platform unit, capable of moving closer to the work surface.

A subsidiary object of the invention is to provide such a platform unit, capable of receiving drilling and other tools and allowing their whole operation.

A subsidiary object of the invention is to provide such a platform unit providing the space required for receiving an operator with specialized workers, in an entirely autonomous manner.

A subsidiary object of the invention is to provide such a platform unit, which reduces work costs and delays.

According to the present invention, there is provided an autonomous tilting platform unit for infrastructure work over a 0–90° slanted surface, comprising:

- a carriage assembly having front and rear portions provided respectively with means for gliding against the slanted surface;
- a platform assembly pivotally connected to the carriage assembly at the front portion thereof;
- an autonomous rotor unit mounted on the carriage assembly through a pendulum assembly;
- a jack means extending between the carriage assembly and the platform assembly, powered by the motor unit for adjustably tilting the platform assembly with respect to the carriage assembly;
- a winch means mounted on the carriage assembly, powered by the motor unit, for hoisting the platform unit along the slanted surface, the winch means having a flexible means for attaching the carriage assembly at an upward point on the slanted surface; and
- a control means mounted on the platform assembly, for operating the motor unit and controlling the jack means and the winch means.

BRIEF DESCRIPTION OF THE DRAWINGS

A detailed description of preferred embodiments will be given hereinbelow with reference to the following drawings, in which like numbers refer to like elements.

DETAILED DESCRIPTION OF THE PREFERRED EMBODIMENTS

Figure 1:
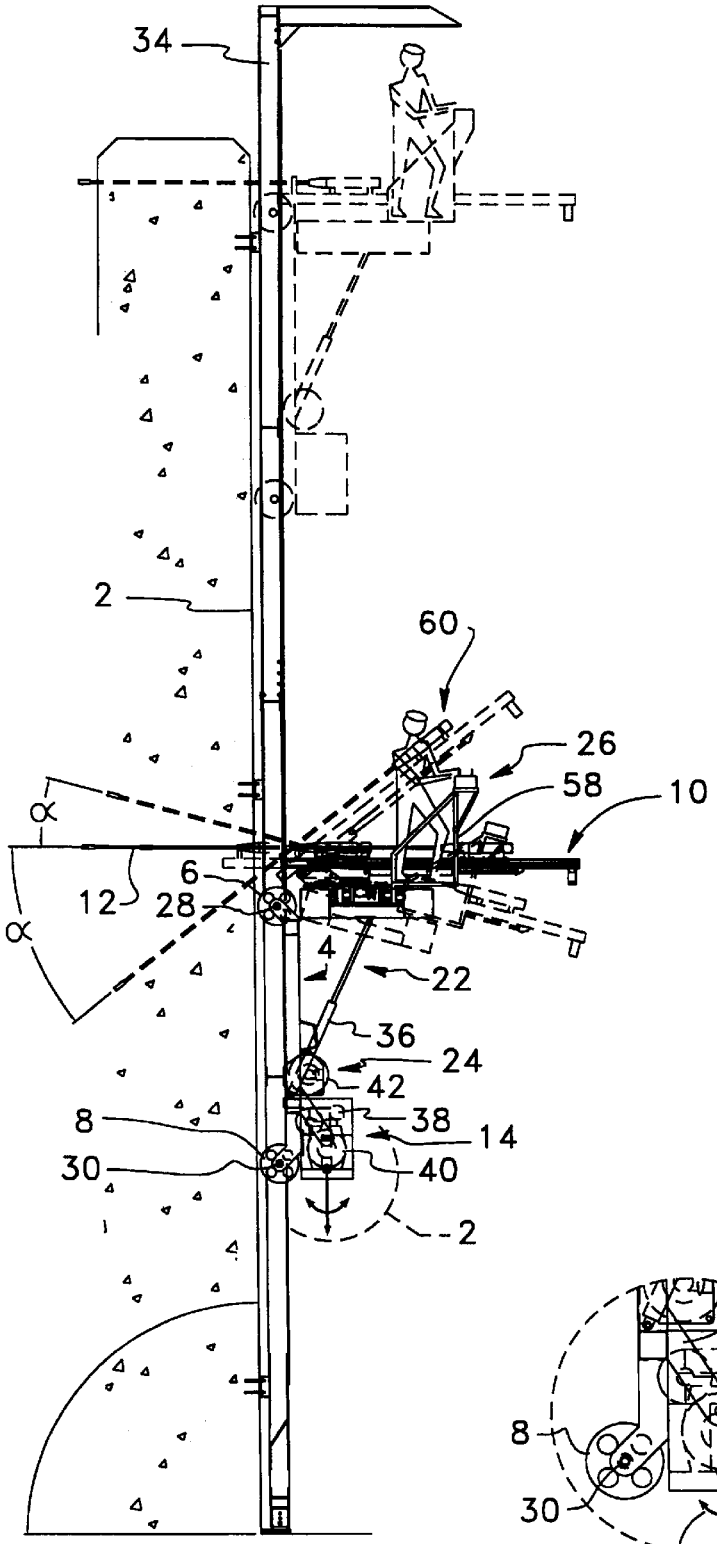
FIG. 1 is a side elevation view showing various positions of a platform unit on a dam runner, according to the invention.
Figure 3:
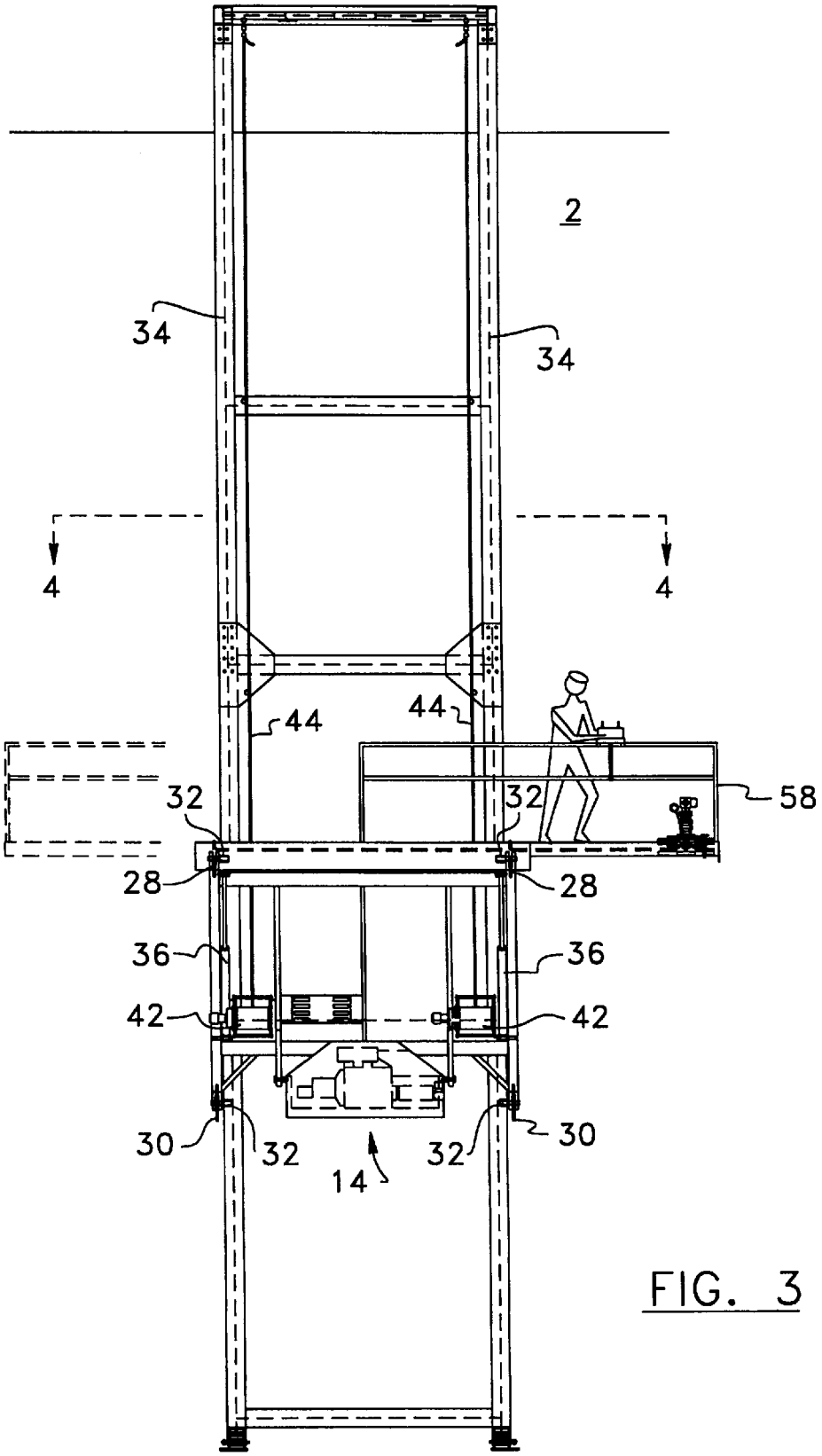
FIG. 3 is a front elevation view showing a platform unit on a dam runner, according to the invention.
Figure 4:
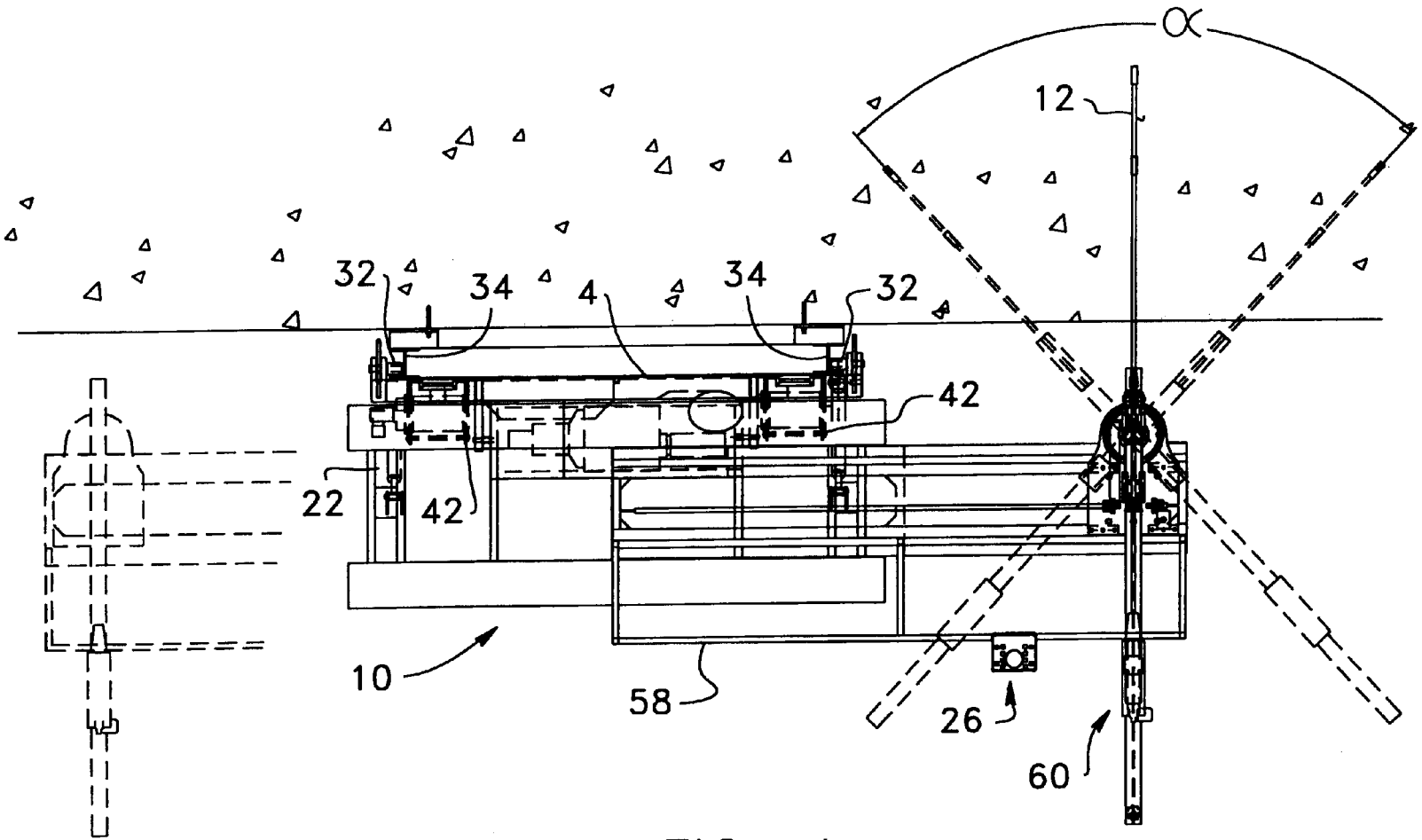
FIG. 4 is a cross section view taken along the line 4—4 in FIG. 31

Referring to FIGS. 1 and 3, there is shown an autonomous tilting platform unit according to the invention, for infrastructure work over a 0–90° slanted surface like the upright face of a concrete dam as illustrated. The platform unit has a carriage assembly 4 having front and rear portions provided with respective pairs of opposite wheels 6, 8 adapted to rest against the slanted surface 2 or a structural member thereupon, and allowing the carriage assembly 4 to glide therealong. The wheels 6, 8 are rotatably mounted on axles 28, 30 secured to the carriage assembly 4. The axles 28, 30 of the wheels 6, 8 of each pair preferably have portions 32 projecting toward each other to provide channel engaging members. Such members are especially useful for holding back the carriage assembly 4 firmly in place over the slanted surface 2 when the slanted surface 2 is provided with runmer channels 34 as best shown in FIG. 4.

Figure 7:
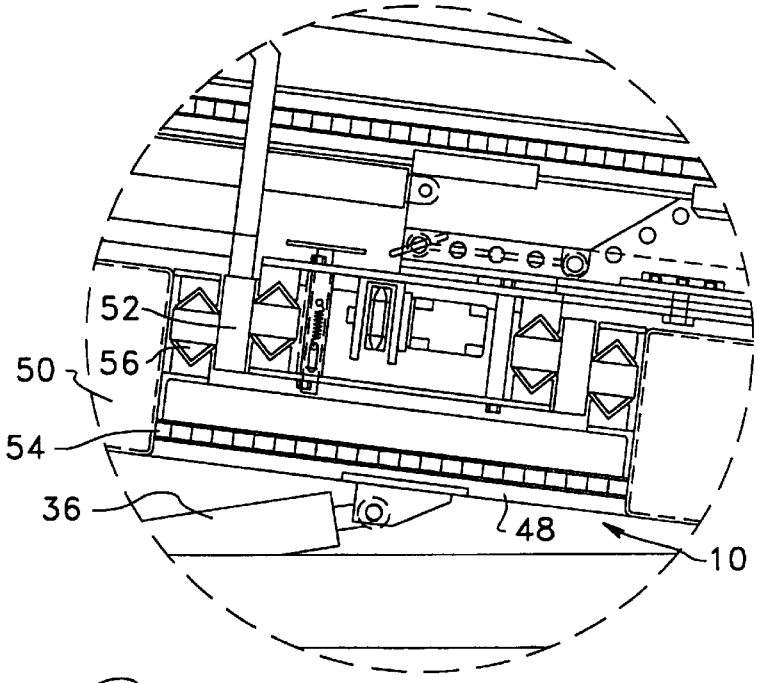
FIG. 7 is a partial enlarged view of the tool installed on the platform unit shown in FIG. 6.

A platform assembly 10 is pivotally connected to the carriage assembly 4 at the front portion thereof by means of a pivot 46 as best shown in FIG. 7, so as to be argularly movable with respect thereto, thereby allowing to change its tilt angle relative to the ground level. This property is useful either for adjusting the tilt angle of a tool 60 mounted onto the platform assembly 10, or for levelling the platform assembly 10 according to the slope of the slanted surface 2.

Figure 2:
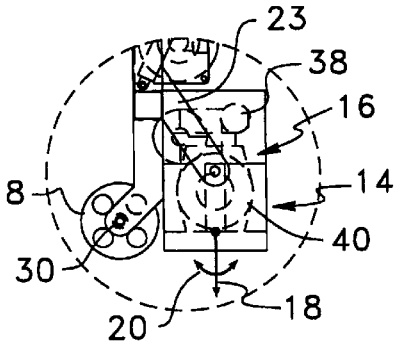
FIG. 2 is a partial enlarged view of the motor of the platform unit shown in FIG. 1.

Referring to FIGS. 1 and 2, an autonomous motor unit 14 is mounted on the carriage assembly 4 through a pendulum assembly 16 as best shown in FIG. 2. The pendulum assembly 16 is formed of a pair of spaced apart brackets 23 mounted onto the carriage assembly 4, the brackets 23 having upper ends between which the motor unit 14 is pivotally hanged. The weight of the motor unit 14, as depicted by the arrow 18, causes it to swivel as depicted by the arrows 20 so as to always remain in the same axis (normally at the horizontal) whatever the tilt angle of the platform unit on the slanted surface 2 is. Such a feature is especially useful when the motor unit 14 comprises an internal combustion engine 40 which under the present state of technology cannot operate past a certain tilting degree.

Ref erring to FIGS. 1 and 3, a jack device 22 extends between the carriage assembly 4 and the platform assembly 10. The jack device 22 is powered by the motor unit 14, for adjustably tilting the platform assembly 10 with respect to the carriage assembly 4. The jack device 22 has a pair of spaced apart, parallel cylinders 36 having ends pivotally connected respectively to the carriage assembly 4 and the platform assembly 10. The cylinders 36 may be hydraulic cylinders. In such a case, the motor unit 14 is provided with a hydraulic pump 38 powered by the combustion engine 40, the hydraulic cylinders 36 then being operated by the hydraulic pump 38.

A winch device 24, powered by the motor unit 14, is mounted on the carriage assembly 4 for hoisting the tilting platform unit along the slanted surface 2, so that the tilting platform unit can be moved at the desired height as shown for example in dashed lines for executing repair or other work. Preferably, the winch device 24 has a pair of spaced apart, independent winches 42 mounted onto the rear portion of the carriage assembly 4 near opposite sides thereof. The winches 42 are provided respectively with steel cables 44 as best shown in FIG. 3, forming flexible means for attaching the carriage assembly 4 at an upward point on the slanted surface 2. The winches 42 may be hydraulic winches operated by the hydraulic pump 38.

A control unit 26 is mounted on the platform assembly 10, for operating the motor unit 14 and controlling the jack device 22 and the winch device 24. To this effect, the control unit 26 controls the combustion engine 40 and the hydraulic pump 38 (provided with an appropriate hydraulic distribution system (not shown) that can easily be designed by any person skilled in the art).

Referring to FIG. 7, the platform assembly 10 comprises a frame 48, a platform 50 slidably mounted onto the frame 48 so that the platform 50 is moveable toward and away from the slanted surface 2, a bridge 52 slidably mounted onto he platform 50 so that the bridge 52 is moveable sideways relative to the slanted surface 2, and a device 54, 55 between the frame 48, the platform 50 and the bridge 52, powered by the motor unit 14, for controllably moving the bridge 52 with respect to the platform 50 and the platfortm 50 with respect to the frame 48. The control unit 26 controls the devices 54, 56 for controllably moving the bridge 52 and the platform 50. The devices 54, 56 can be formed of sprocket wheels between and in engagement with respective opposite dented rails, the sprocket wheels being operated by the motor unit 14. Any other suitable device can be used to move the bridge 52 relative to the platform 50 relative to the frame 48. For example, hydraulic cylinders or a multi-stage clutched gearing system can be used. Depending on the needs, the bridge 52 may be the only moveable part, or the platform 50, or even none of them.

Figure 5:
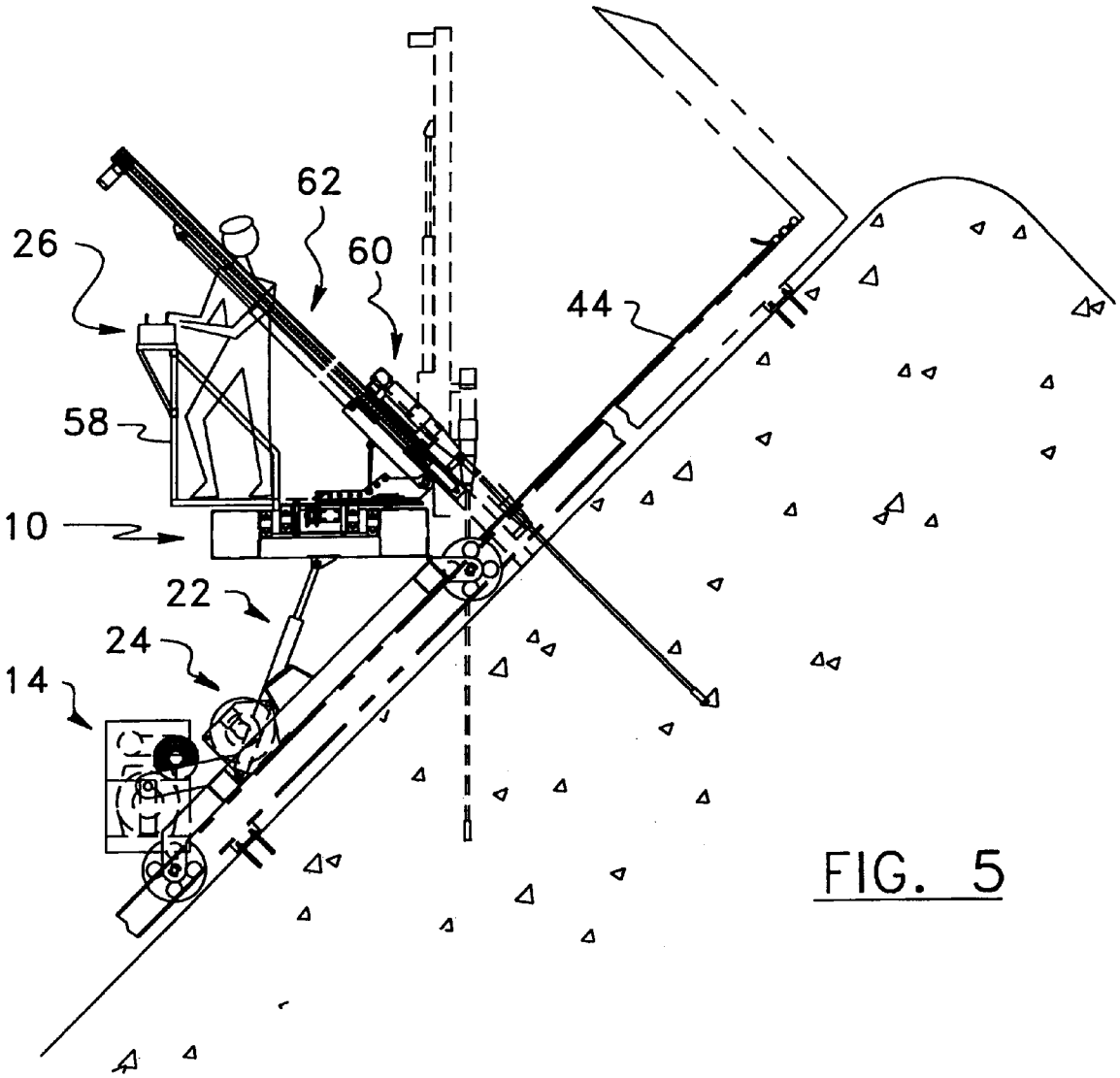
FIG. 5 is a side view showing a platform unit on a slanted work surface, according to the invention.
Figure 6:
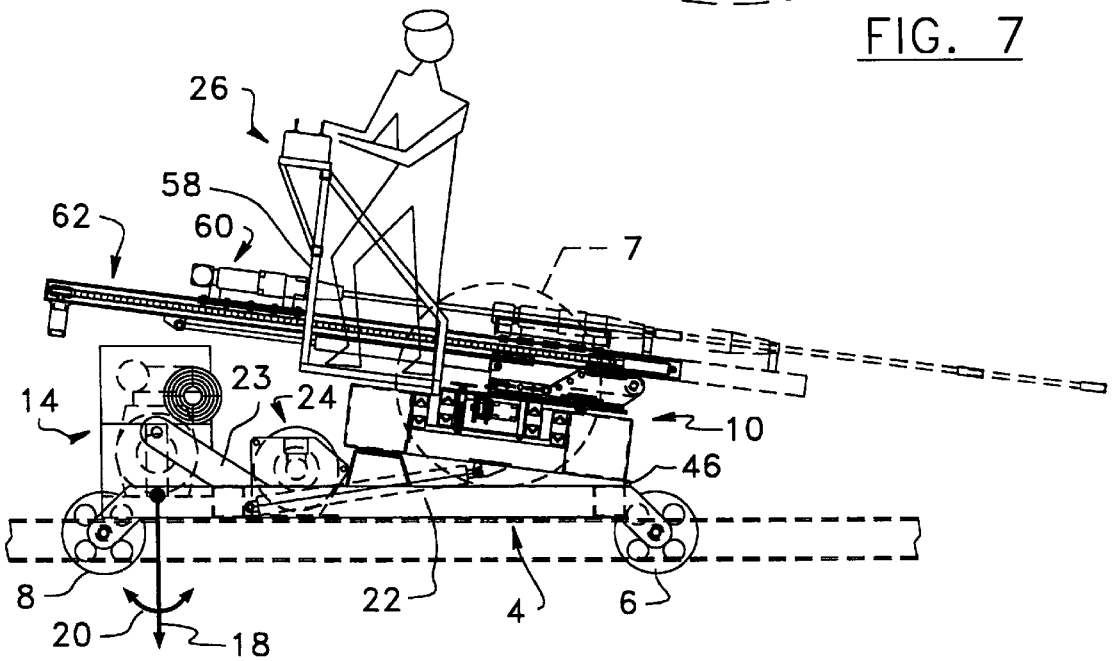
FIG. 6 is a side view showing a platform unit on a level work surface, according to the invention.

Preferably, the platform assembly 10 is provided with an upwardly projecting side railing 58, as best shown in FIGS. 3 and 6. The top mobile bridge 52 should be sized to receive at least one operator and working equipment such as a drill 60 with an articulated drilling mast 62 as best shown in FIG. 5. The drilling mast 62 may be operated by the motor unit 14 and the control unit 26. The platform unit can be provided with a pneumatic system (not shown in the figures) powered by the combustion engine 40 if pneumatic work equipment is used. The platform unit can thereby receive various tools and implements, like a hydraulic hammer, an agitator, pins and other materials, etc. If the working conditions are considered to be dangerous, then the control unit 26 may rather be in the form of a remote control (not shown in the figures), thereby allowing the operator to control the platform unit and the equipment in a simple and safe manner.

The installation of the platform unit on the slanted surface 2 can be achieved with a temporary crane (not shown in the figures), which is not required during the time for achieving the work on the structure. Thus the crane can be dispatched elsewhere, and is not mobilized by the platform unit. As soon as the cables 44 are secured to the runner head, the platform unit becomes totally autonomous. Using the winches 42, the platform unit can be hoisted and halted at any desired height on the structure. The operator has all the necessary displacement axes to allow for example a drilling operation at the designed spot and angle with high accuracy, as the platform assembly 10 can be moved laterally as well as frontward or rearward relative to the surface 2.

The platform unit according to the invention has attributes that allow execution of the work at an incomparable speed, and presents qualities of flexibility as various tools can be integrated thereto, notwithstanding that the required materials for the work can be laid down on the platform unit. Preferably, the platform unit has a capacity load of 1.5 ton and meets the vibration stress caused by a drill.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. An autonomous tilting platform unit for infrastructure work over a 0–90° slanted surface, comprising:

a carriage assembly having front and rear portions provided respectively with means for gliding against the slanted surface;

a platform assembly pivotally connected to the carriage assembly at the front portion thereof;

an autonomous motor unit mounted on the carriage assembly through a pendulum assembly;

a jack means extending between the carriage assembly and the platform assembly, powered by the motor unit for adjustably tilting the platform assembly with respect to the carriage assembly;

a winch means mounted on the carriage assembly, powered by the motor unit, for hoisting the platform unit along the slanted surface, the winch means having a flexible means for attaching the carriage assembly at an upward point on the slanted surface; and a control means mounted on the platform assembly, for operating the motor unit and controlling the jack means and the winch means.

2. The tilting platform unit according to claim 1, wherein:

the platform assembly comprises a frame, a platform slidably mounted onto the frame so that the platform is moveable toward and away from the slanted surface, and a means between the platform and the frame, powered by the motor unit, for controllably moving the platform with respect to the frame; and the control means controls the means for controllably moving the platform.

3. The tilting platform unit according tc claim 1, wherein:

the platform assembly comprises a frame, a bridge slidably mounted onto the frame so that the bridge is moveable sideways relative to the slanted surface, and a means between the frame and the bridge, powered by the motor unit, for controllably moving the bridge with respect to the frame; and the control means controls the means for controllably moving the platform.

4. The tilting platform unit according to claim 1, wherein:

the platform assembly comprises a frame, a platform slidably mounted onto the frame so that the platform is moveable toward and away from the slanted surface, a bridge slidably mounted onto the platform so that the bridge is moveable sideways relative to the slanted surface, and a means between the frame, the platform and the bridge, powered by the motor unit, for controllably moving the bridge with respect to the platform and the platform with respect to the frame; and the control means controls the means for controllably moving the bridge and the platform.

5. The tilting platform unit according to claim 1, wherein:

the jack means comprises a pair of spaced apart, parallel cylinders having ends pivotally connected respectively to the carriage assembly and the platform assembly.

6. The tilting platform unit according to claim 5, wherein:

the cylinders are hydraulic cylinders; and the motor unit comprises an internal combustion engine and a hydraulic pump powered by the combustion engine, the hydraulic cylinders being operated by the hydraulic pump, the control means controlling the combustion engine and the hydraulic pump.

7. The tilting platform unit according to claim 1, wherein:

the winch means comprises a pair of spaced apart, independent winches mounted onto the rear portion of the carriage assembly near opposite sides thereof, the winches being provided respectively with steel cables forming the flexible means.

8. The tilting platform unit according to claim 7, wherein:

the winches are hydraulic winches; and the motor unit comprises an internal combustion engine and a hydraulic pump powered by the combustion engine, the hydraulic winches being operated by the hydraulic pump, the control means controlling the combustion engine and the hydraulic pump.

9. The tilting platform unit according to claim 1, wherein the pendulum assembly comprises a pair of spaced apart brackets mounted onto the carriage assembly, the brackets having upper ends between which the motor unit is pivotally hanged.

10. The tilting platform unit according to claim 1, wherein the platform assembly is provided with an upwardly projecting side railing.

11. The tilting platform unit according to claim 1, wherein the platform assembly comprises a top mobile bridge sized to receive at least one operator and drilling equipment.

12. The tilting platform unit according to claim 1, wherein the means for gliding comprises pairs of opposite wheels mounted respectively at the front and rear portions of the carriage assembly.

13. The tilting platform unit according to claim 12, wherein:

the wheels are rotatably mounted on axles secured to the carriage assembly, the axles of the wheels of each pair having portions projecting toward each other to provide channel engaging members.

* * * * *